United States Patent [19]

Cinalli

[11] Patent Number: 4,701,667

[45] Date of Patent: Oct. 20, 1987

[54] EXPANDABLE STARTING AID RING FOR FLUORESCENT LAMP

[75] Inventor: James A. Cinalli, Fairmont, W. Va.

[73] Assignee: North American Philips Corporation, New York, N.Y.

[21] Appl. No.: 640,255

[22] Filed: Mar. 17, 1986

[51] Int. Cl.[4] ..... H01J 61/54

[52] U.S. Cl. ..... 313/594

[58] Field of Search ..... 313/594, 601, 602

[56] References Cited

U.S. PATENT DOCUMENTS 4,463,280 7/1984 Hammer et al. ..... 313/594

FOREIGN PATENT DOCUMENTS 914686 10/1946 France .

*Primary Examiner*—David K. Moore
*Assistant Examiner*—K. Wieder
*Attorney, Agent, or Firm*—John C. Fox

[57] ABSTRACT

Ring-shaped starting aids of spring steel for fluorescent lamps each include two U-shaped bends. These bends enable expansion of the rings to accommodate varying outside diameters of the lamp bulbs, while insuring firm contact between the rings and the bulb surface.

3 Claims, 6 Drawing Figures

EXPANDABLE STARTING AID RING FOR FLUORESCENT LAMP

BACKGROUND OF THE INVENTION

This invention relates to discharge lamps such as fluorescent lamps, and more particularly relates to starting aids for such lamps which are expandable to accommodate normal variations in lamp bulb diameter.

It is well known that lamp starting voltage is a function of surface resistance of a fluorescent lamp, and that starting voltage may be reduced by laying a conducting stripe or film on the inner or outer surface of the lamp bulb. See Electric Discharge Lamps, John F. Waymouth, The MIT Press, Cambridge, Mass., 1978, p. 69.

It is also known to improve starting voltage by applying starting aids around the periphery of the bulb in the vicinity of the electrodes. See U.S. Pat. Nos. 4,463,280 and 4,468,591. These starting aids are in the form of conductive bands in contact with the outer glass surface of the bulb.

In one design, this starting band is in the form of a split ring which is secured in place with adhesive tape. The split ring accommodates the normal variation in bulb diameter encountered in mass production. However, the taping operation tends to be labor intensive and does not always result in the firm contact needed for improved starting.

Accordingly, it is an object of this invention to provide an improved starting aid for discharge lamps which will accommodate different bulb diameters without requiring a separate attachment operation.

It is another object of the invention to provide such an improved starting aid which will make the firm contact with the bulb surface needed for improved starting regardless of bulb diameter.

SUMMARY OF THE INVENTION

In accordance with the invention, a discharge lamp comprises an elongated bulb, a pair of electrodes inside the bulb near the ends of the bulb, a fill of materials inside the bulb capable of sustaining a luminous discharge, and at least one starting aid surrounding the outer surface of the bulb in the vicinity of the electrode, the aid comprising a ring of electrically conductive spring material, the ring including at least one expandable upstanding bend.

In accordance with a preferred embodiment, the lamp comprises a shaped fluorescent lamp in which the bulb ends are substantially closer together than if the bulb were straight, and there are two starting aids, one at each end of the bulb, and an electrically conductive support means extends between the bulb ends for electrically interconnecting the starting aids and for supporting the bulb ends.

In accordance with the most preferred embodiment, the starting aids of the shaped fluorescent lamp each include two expandable upstanding bends, the bends located on opposite sides of and within 60 degrees of the central axis plane of the bulb.

DESCRIPTION OF THE PREFERRED EMBODIMENT

Figure 1A:
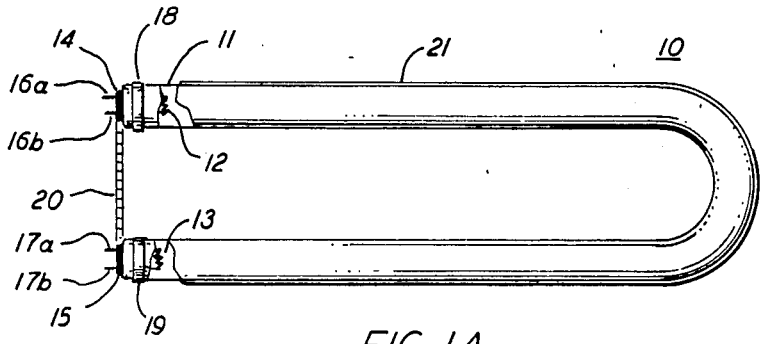
FIG. 1A Prior Art
FIG. 1A is a plan view of a U-shaped fluorescent lamp of the prior art having two split ring starting aids near the lamp ends.
Figure 1B:
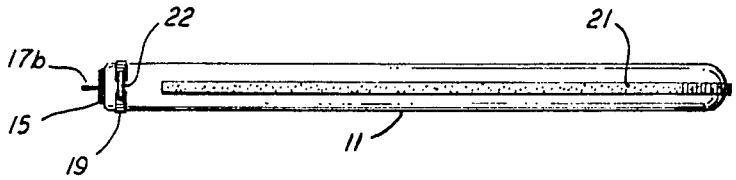
FIG. 1B Prior Art
FIG. 1B is a side view of the lamp of FIG. 1A showing one of the split ring starting aids.
Figure 2:
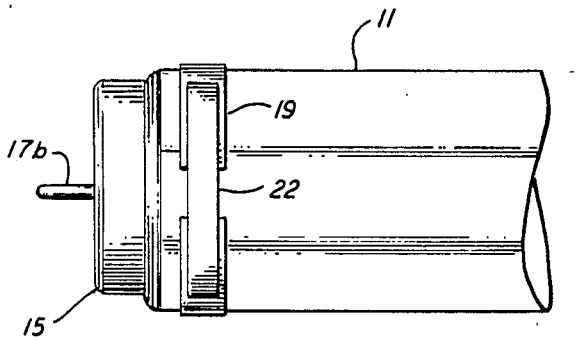
FIG. 2 Prior Art
FIG. 2 is an enlargment of the end portion of the view of FIG. 1B, showing the taped split ring starting aid.

Referring now to FIG. 1A, U-shaped fluorescent lamp 10 includes U-shaped bulb 11, electrodes 12 and 13 near the ends of the bulb, and bases 14 and 15 supporting socket pins 16*a*, 16*b*, 17*a* and 17*b*. A pair of splie ring starting aids 18 and 19 contact the outer surface of the bulb between the electrode filaments and the bulb ends, as shown. Electrically conducting support rod 20 connects the split ring starting aids, and also lends mechanical stability to the lamp. Starting aid stripe 21 extends along the sides of the bulb forward of the electrodes, as shown. The bulb is filled with materials capable of sustaining a gaseous discharge, and producing a luminous output. The compositions of suitable fills are well known, and their description is unnecessary to an understanding of the invention.

Side views 1B and 2 show the location of the split in one of the split ring starting aids 19, and also show tape 22, which has been applied to proviide electrical continuity across the split, as well as to hold the split ring in contact with the glass surface of the bulb 11. Tape 22 is of a type capable of withstanding the temperatures encountered during the subsequent basing operation, eg., 500° F., such as an adhesive tape with a tin backing.

The split ring arrangement of the prior art offered the convenience of being able to accommodate the variations in bulb diameter normally encountered in mass production. However, it proved to be disadvantageous in requiring the addition of adhesive tape across the split to achieve contact with the glass surface of the bulb necessary for the starting aid to be functional. Not only did the addition of the tape increase the cost of production, but it failed to consistently achieve the firm contact with the glass surface found to be necessary for reliable lamp starting.

Figure 3:
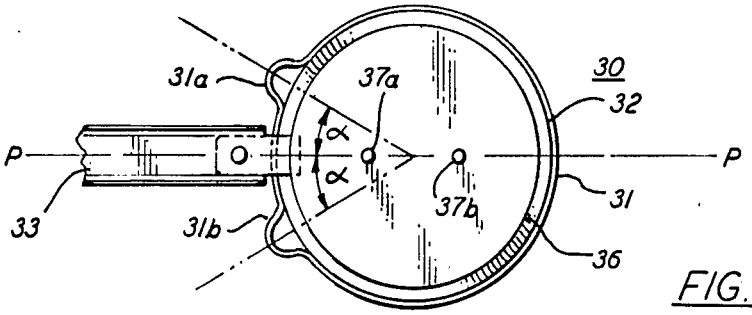
FIG. 3 is an end view of one end of a U-shaped fluorescent lamp having an expandable starting aid ring of the invention.
Figure 4:
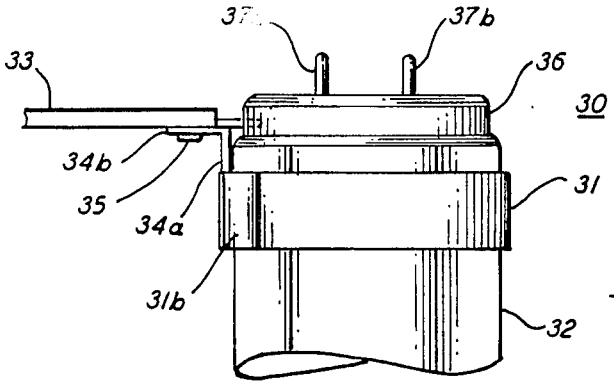
FIG. 4 is a plan view of the lamp end of FIG. 3.
Figure 5:
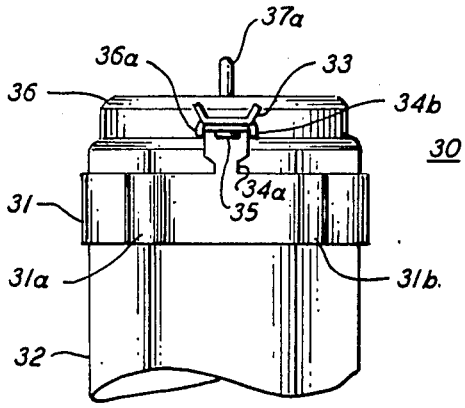
FIG. 5 is a side view of the lamp end of FIG. 3.

Referring now to FIGS. 3 through 5, there are shown end, plan and side views, respectively, of the end of a U-shaped fluorescent lamp 30 having a starting aid of the invention which substantially overcomes the above disadvantages of the prior art.

Expandable starting aid ring 31 completely surrounds and is in firm contact with bulb 32 of lamp 30. The ring is composed of an electrically conducting spring material, such as stainless steel, and includes two upstanding expandable U-shaped bends 31*a* and 31*b*.

These bends are each located at an angle alpha with respect to the central axis plane P of the lamp. Preferably, the angle alpha is less than 60 degrees, so that the bends are located on the inside of the U, away from the points at which the lamp would make resting contact with a flat surface such as a table.

The bends should be large enough to allow sufficient ring expansion to accommodate the variations in bulb outside diameter normally encountered in mass production. A general guide is to have the height of the bend be from 10 to 20 percent of the diameter of the ring, and the width of the bend from about 0.5 to 2 times the height of the bend.

By way of example, for this type of fluorescent lamp, the bulb outside diameter typically varies from 1.450 to 1.505 inches. Such variation may easily be accommodated by a ring having an inside diameter of 1.450+0.000–0.005 inches, and two U-shaped bends having a height of 0.192 inches and a width of 0.197 inches. Alternatively, such variation could be accommodated by a single U-shaped bend having a height of 0.225 inches and a width of 0.250 inches.

The ring 31 is preferably seamless, in order to achieve as much contact with the bulb surface as possible, but cost considerations may dictate that the ring have a seam, such as a butt- or lap-welded seam or a lock seam.

In practice, two starting aid rings are joined to the ends of the support rod 33, and the resulting assembly is slipped onto the ends of the bulb prior to attaching the bases. Subsequently, the assembly is held in place by securing the ends of the rod under notches 36*a* in the bases.

Ring 31 is attached to U-shaped support rod 33 by means of L-shaped bracket 34, an integral extension of ring 31. L-shaped bracket 34 is composed of base 34*a* and upstanding potion 34*b*. The bracket 34 is joined to the support rod 33 by any suitable means, such as welding, riveting or squirting.

As is known, squirting may be carried out by forming an aperture in one member while in contact with a second, apertured member to "squirt" material through the aperture of the second member, thereby forming a bond between the two members. In FIGS. 4 and 5, a squirted joint between rod 33 and upstanding member 34*b* includes flared portion 35 of the squirted material from rod 33.

The invention has been described in terms of a limited number of embodiments. Other embodiments are contemplated, such as different shapes of expandable bends. For example, such bends could be V-shaped, box-shaped or corrugated.

What is claimed is:

1. A discharge lamp comprising an elongated bulb, the bulb shaped so that its ends are substantially closer together than if the bulb were straight, a pair of electrodes inside the bulb near the ends of the bulb, a fill of materials inside the bulb capable of sustaining a gaseous discharge and producting a luminous output, and at least two starting aids surrounding the outer surface of the bulb in the vicinity of the electrodes, an electrically conductive support means extending between the bulb ends for electrically interconnecting the starting aids and for supporting the ends of the bulb, each starting aid comprising a ring of electrically conducting spring material, the ring including at least two U-shaped expandable upstanding bends, the bends located on opposite sides of a plane lying in the central axis of the lamp to form an angle of less than about 60 degrees with the plane, the height of the bends being from 10 to 20 percent of the diameter of the ring, and the width of the bends being from about 0.5 to 2 times the height of the bends.

2. The lamp of claim 1 in which the starting aids are each attached to the support means by an L-shaped apertured bracket extending from the ring and lying in the central axis plane.

3. The lamp of claim 1 in which a third starting aid comprising a stripe of conductive material, extends continuously along a portion of the bulb and has ends terminating forward of each electrode.

* * * * *